US011731182B2

(12) United States Patent
Grant et al.

(10) Patent No.: US 11,731,182 B2
(45) Date of Patent: Aug. 22, 2023

(54) INTEGRATED STRAIGHTENER HEAD MODIFICATIONS AND IMPROVEMENTS

(71) Applicant: Coe Press Equipment Corp., Sterling Heights, MI (US)

(72) Inventors: Bruce R. Grant, Clarkston, MI (US); Akshai Nakkana, Rochester, MI (US); Ervin Lee Brooks, Clinton Township, MI (US)

( * ) Notice: Subject to any disclaimer, the term of this patent is extended or adjusted under 35 U.S.C. 154(b) by 1070 days.

(21) Appl. No.: 15/859,995

(22) Filed: Jan. 2, 2018

(65) Prior Publication Data

US 2018/0185898 A1 Jul. 5, 2018

Related U.S. Application Data

(60) Provisional application No. 62/441,616, filed on Jan. 3, 2017.

(51) Int. Cl.
*B21D 1/02* (2006.01)

(52) U.S. Cl.
CPC ..... *B21D 1/02* (2013.01)

(58) Field of Classification Search
CPC ... B21D 1/02; B21B 2015/0071; B21B 31/02; B21B 31/16; B21B 31/20
USPC ..... 72/160, 163–165
See application file for complete search history.

(56) References Cited

U.S. PATENT DOCUMENTS

| | | | | | |
|---|---|---|---|---|---|
| 2,091,789 | A * | 8/1937 | Maussnest | B21D 1/02 | 72/183 |
| 2,429,142 | A * | 10/1947 | Thomas | B21D 1/02 | 72/163 |
| 2,963,070 | A * | 12/1960 | Maust | B21D 1/02 | 72/31.07 |
| 2,999,530 | A * | 9/1961 | Ungerer | B21D 3/05 | 72/163 |
| 3,704,614 | A * | 12/1972 | Keyser | B21D 1/02 | 72/165 |
| 3,748,825 | A * | 7/1973 | Chant, Jr. | B65B 9/06 | 53/371.5 |
| 3,916,662 | A * | 11/1975 | Arnold | B21D 3/05 | 72/31.07 |

(Continued)

*Primary Examiner* — Shelley M Self
*Assistant Examiner* — Fred C Hammers
(74) *Attorney, Agent, or Firm* — Law Offices of: John G. Posa

(57) ABSTRACT

Improvements and modifications to coil steel straighteners provide an integrated structural head that allows for quicker setup of the equipment, integrated lower backup rolls to the structural head, self-aligning rollers, setup timing blocks for equipment calibration, and adjustment screw jacks that allow for narrower center distances and include pointers and scales internally. The backup rollers for each work roller are supported on separate backup roller plates enabling the backup rollers for each work roller to removably installed and independently adjusted. The backup rollers may be supported between opposing blocks and adjusted by moving the blocks toward and away from the backup roller plate using leveling jacks. The work rollers associated with the upper bank may be supported between opposing slide blocks that move up and down in slots formed in opposing side plates, with visual indicators to establish a zero position associated with each work roller in the upper bank.

17 Claims, 4 Drawing Sheets

(56) References Cited

U.S. PATENT DOCUMENTS

| | | | | | |
|---|---|---|---|---|---|
| 5,758,533 | A * | 6/1998 | Quehen | B21D 1/02 | 72/163 |
| 6,067,835 | A * | 5/2000 | Pollock | B21F 1/02 | 140/147 |
| 6,085,564 | A * | 7/2000 | Veit | B21F 1/02 | 72/164 |
| 6,345,524 | B1 * | 2/2002 | Fischer | B21D 1/02 | 72/164 |
| 8,997,539 | B2 * | 4/2015 | Clark | B21B 37/28 | 72/11.6 |
| 2007/0277463 | A1 * | 12/2007 | Heirich | B21D 5/08 | 52/309.16 |
| 2009/0113973 | A1 * | 5/2009 | Cox, III | B21B 15/00 | 72/165 |
| 2012/0103047 | A1 * | 5/2012 | Abe | B21B 31/10 | 72/164 |
| 2014/0083153 | A1 * | 3/2014 | Mullerleile | B21D 1/02 | 72/252.5 |

* cited by examiner

INTEGRATED STRAIGHTENER HEAD MODIFICATIONS AND IMPROVEMENTS

REFERENCE TO RELATED APPLICATIONS

This application claims priority to U.S. Provisional Patent Application Ser. No. 62/441,616, filed Jan. 3, 2017, the entire content of which is incorporated herein by reference.

FIELD OF THE INVENTION

This invention relates generally to material handling and feeding equipment and, in particular, to improvements and modifications associated with coil steel straighteners.

BACKGROUND OF THE INVENTION

The metal forming and stamping industries commonly use material handling and feeding equipment to process coil steel into stamping presses and other metal forming machinery. This equipment includes coil unwinders, straighteners, threading equipment and feeders to handle, unwind, straighten and feed unprocessed coil metals, and to flatten the material adequately so that it can be presented to presses for forming or stamping processes.

Conventional straighteners utilize a series of rollers of various diameters, spacing, and width that are sized to match press capacities and metal properties. The aligned rollers, configured in upper and lower banks, are located on both sides of the presented material to apply adequate bending to stress the material beyond its yield strength. The rollers (banks) must be precisely positioned during equipment build and properly supported or "backed up" to counter the internal loads and stresses experienced during processing.

It is common that the upper and lower roller banks are supported with backup rollers to provide the necessary support and rigidity to prevent the work rollers from deflecting. However, the technique and features to allow precise and controlled positioning, timing, and alignment of the backup rollers are complicated to implement and maintain on given pieces of straightener equipment.

SUMMARY OF THE INVENTION

This invention resides in various improvements and modifications applicable to coil steel straighteners. These improvements and modifications provide an integrated structural head that allows for quicker setup of the equipment, integrated lower backup rolls to the structural head, self-aligning rollers, setup timing blocks for equipment calibration, and adjustment screw jacks that allow for narrower center distances and include pointers and scales internally. The improvements and modifications are patentably distinct, such that they may be implemented separately or, more preferably, in combination.

Applicable straighteners include upper and lower banks of work rollers for receiving material to be straightened, each work roller being rotatable about a respective axis of rotation. A plurality of backup rollers associated with each work roller reduce deformation of the work roller during the straightening operation.

In accordance with one embodiment of the invention, the backup rollers for each work roller are supported on separate backup roller plates that are longitudinally aligned with the work rollers, enabling the backup rollers for each work roller to removably installed and independently adjusted. The backup rollers may be supported between opposing blocks and adjusted by moving the blocks toward and away from the backup roller plate using leveling jacks that are fixed in position with jam nuts once the desired degree of contact is achieved. Longitudinal support plates may be affixed to the back surface of each backup roller plate to reduce deformation of the backup roller plates.

The work rollers associated with the upper bank may be supported between opposing slide blocks that move up and down in slots formed in opposing side plates, and the slide plates and slots may include visual indicators to establish a zero position associated with each work roller in the upper bank. In the preferred embodiment, the visual indicators are notches or cutouts in the slide blocks and the slots. The notches or cut-outs in the slide blocks may be precisely located based upon the distance to the center of the work roll in that slide block, or the notches or cut-outs in the side plates are precisely located based upon the distance to the plane of the lower work rolls. In any case, the zero position may be used to calibrate encoders, digital readouts or mechanical scale markers.

DETAILED DESCRIPTION OF THE PREFERRED EMBODIMENTS

As mentioned in the Background of the Invention, straighteners include upper and lower banks of straightening rollers or "work rolls" that are supported or "backed up" with upper and lower backup rollers to keep the work rolls properly aligned and free from deformation. As such, the backup rollers need to be positioned accurately against the work rolls to provide uniform contact and without applying too much pressure. Traditionally, however, the lower backup rollers were coupled to structures associated with the cabinet or support base. However, this configuration results in an arrangement that is difficult to assemble and difficult to maintain.

Figure 1:
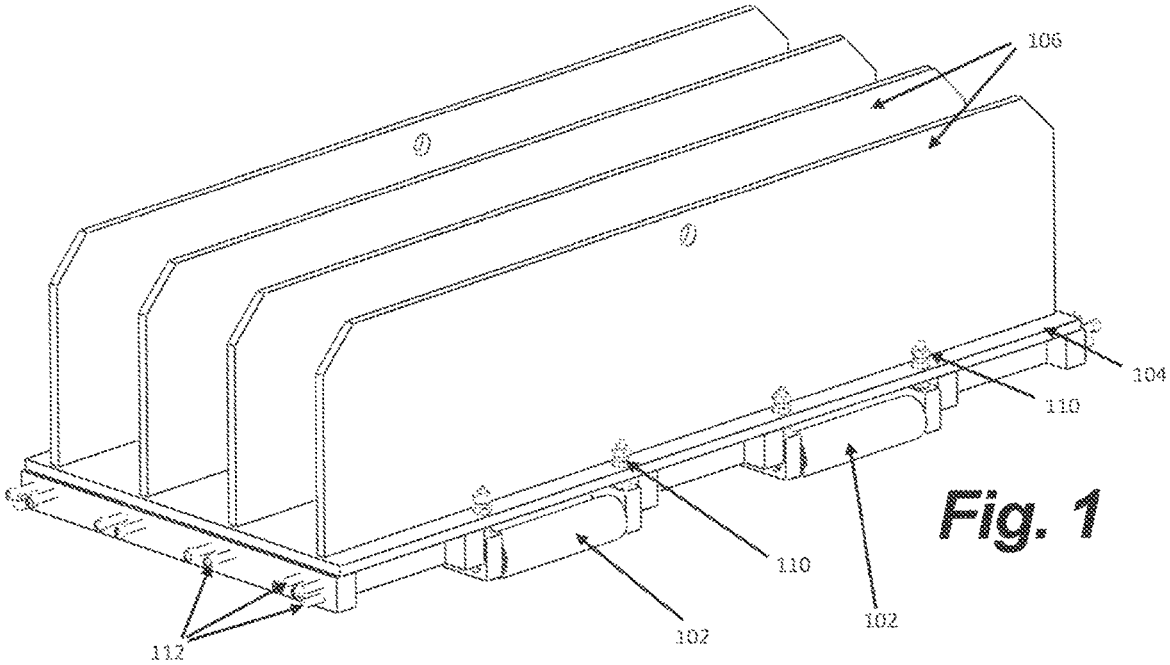
FIG. 1 shows a lower backup roller assembly and, in particular, the arrangement for the lower bank, wherein a single plate can be used since the lower work rolls are parallel and supported in a common plane.

One aspect of this invention provides a separate backup roller assembly enabling the rollers to be assembled and aligned independently of the equipment, facilitating easier installation and maintenance. FIG. 1 shows a lower backup roller assembly which includes a plate 104 having a first surface with spaced apart backup rollers 102 and an opposing surface with perpendicular panels 106 mounted to the surface, as through welding. In the preferred embodiment, the plane of each panel 106 is aligned to respective set of backup rollers. The size and thickness of the panels 106 may be varied to match loading and other stresses experienced by the work rolls.

The invention allows the components of FIG. 1 to be assembled outside of the equipment base then placed into position. In the preferred embodiment dowel pins and bolts 112 are used to align and secure the assembly to the straightener head, providing a strong, precise alignment. This aspect of the invention is applicable to both the upper and lower banks of work rolls. FIG. 1 shows the arrangement for the lower bank, wherein a single plate 104 can be used since the lower work rolls are parallel and supported in a common plane. In the upper bank, a separate plate and panel are used for each set of backup rollers, with the plate being mounted to the slide blocks (using dowel pins) so the backup rolls move up and down with the upper work rolls.

Figure 2:
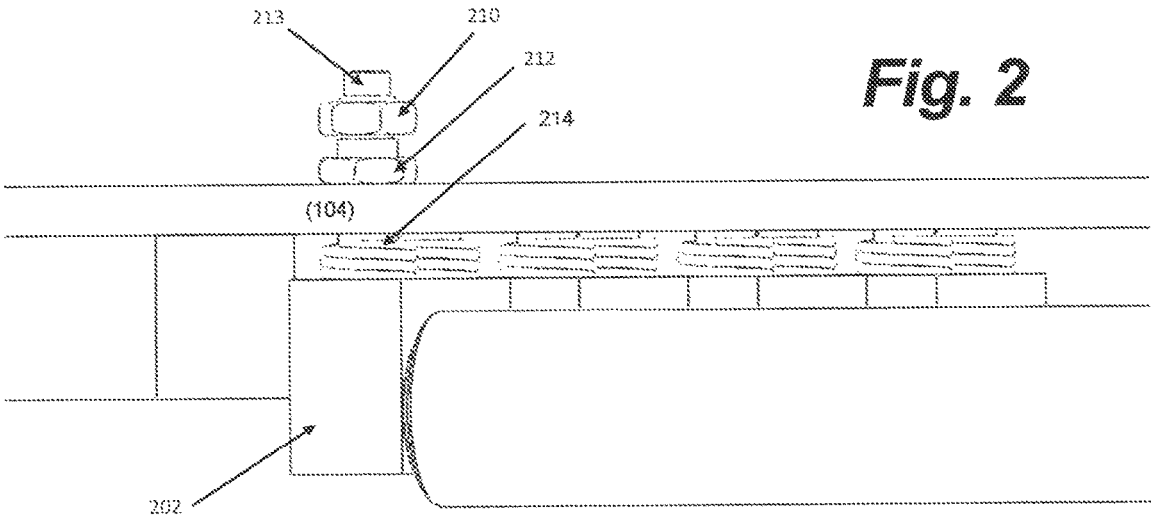
FIG. 2 illustrates how pairs of backup rollers are supported between blocks which are in turn coupled to plate(s) through threaded adjustment fasteners called leveling jacks.
Figure 3:
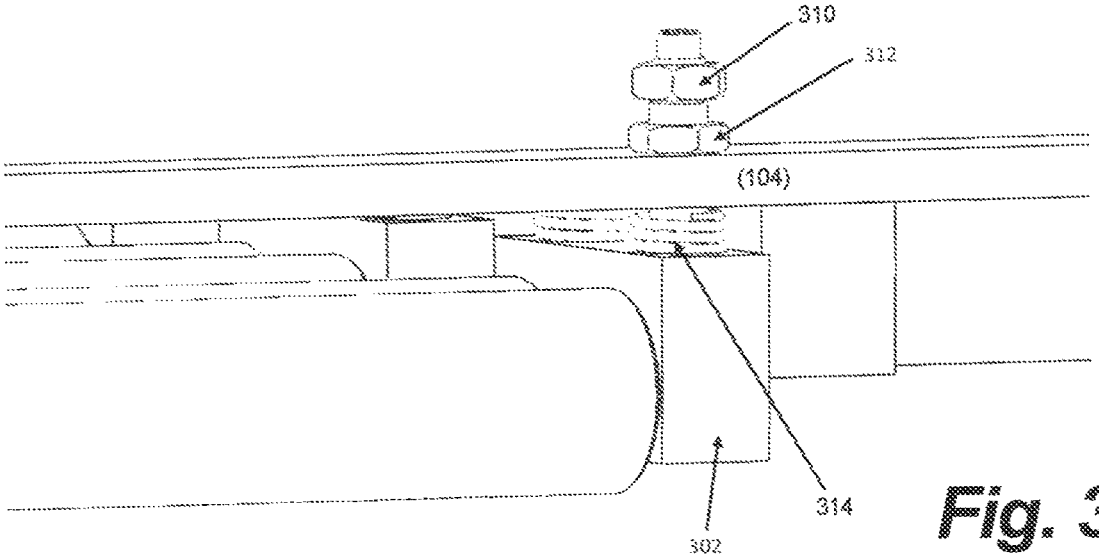
FIG. 3 is a different view of the way in which pairs of backup rollers are supported. Tensioning springs are provided to ensure accurate position and contact pressure between the backup rollers and work roll.

Once the backup roll assemblies are mounted in position, another aspect of the invention makes movement of the backup rollers against the work rolls much easier. As shown in FIG. 2 and FIG. 3, pairs of backup rollers are supported between blocks 202 and 302 which are in turn coupled to the plate(s) through threaded adjustment fasteners called leveling jacks, 210 and 310. Tensioning springs are provided to ensure accurate position and contact pressure between the backup rollers and work roll.

At this point, the leveling jacks are adjusted until they come in contact with blocks 202 and 302. Once the leveling jacks are in position, the jam-nuts 212 and 312 are used to lock the leveling jacks 210 and 310 to the support frame 204 and 304. Then the locking bolts 213 are tightened to secure the end blocks 202 and 302 to the leveling jacks.

Figure 5:
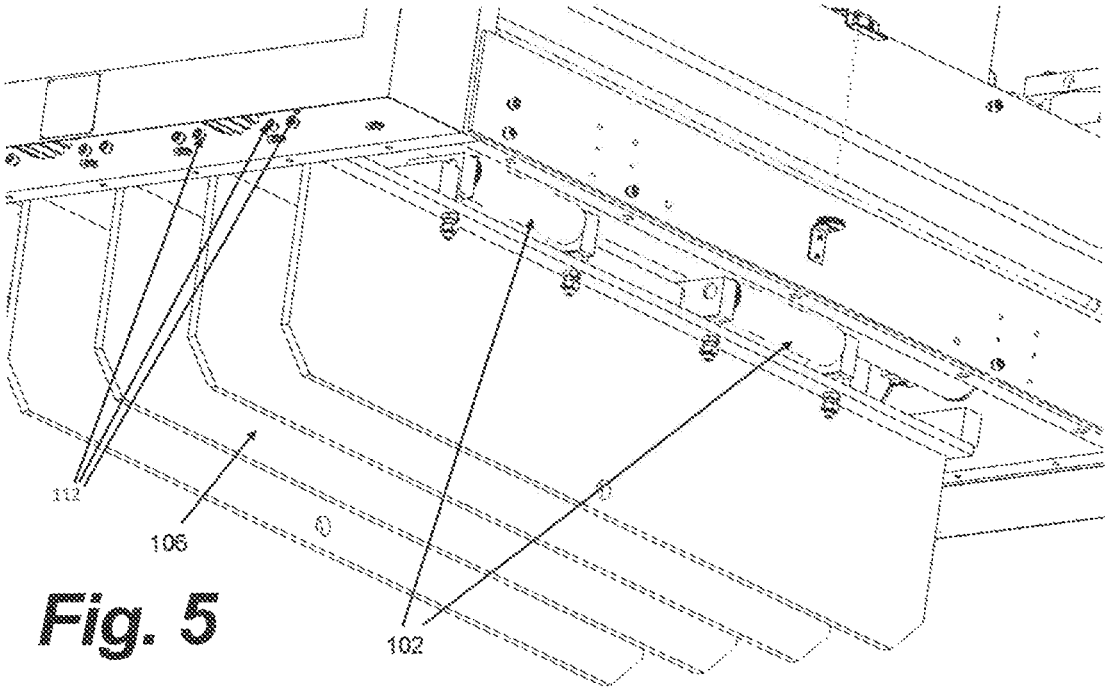
FIG. 5 provides a different perspective of the lower backup roller assembly showing the dowel pins and bolts aligning and securing the assembly to the straightener head.
Figure 6:
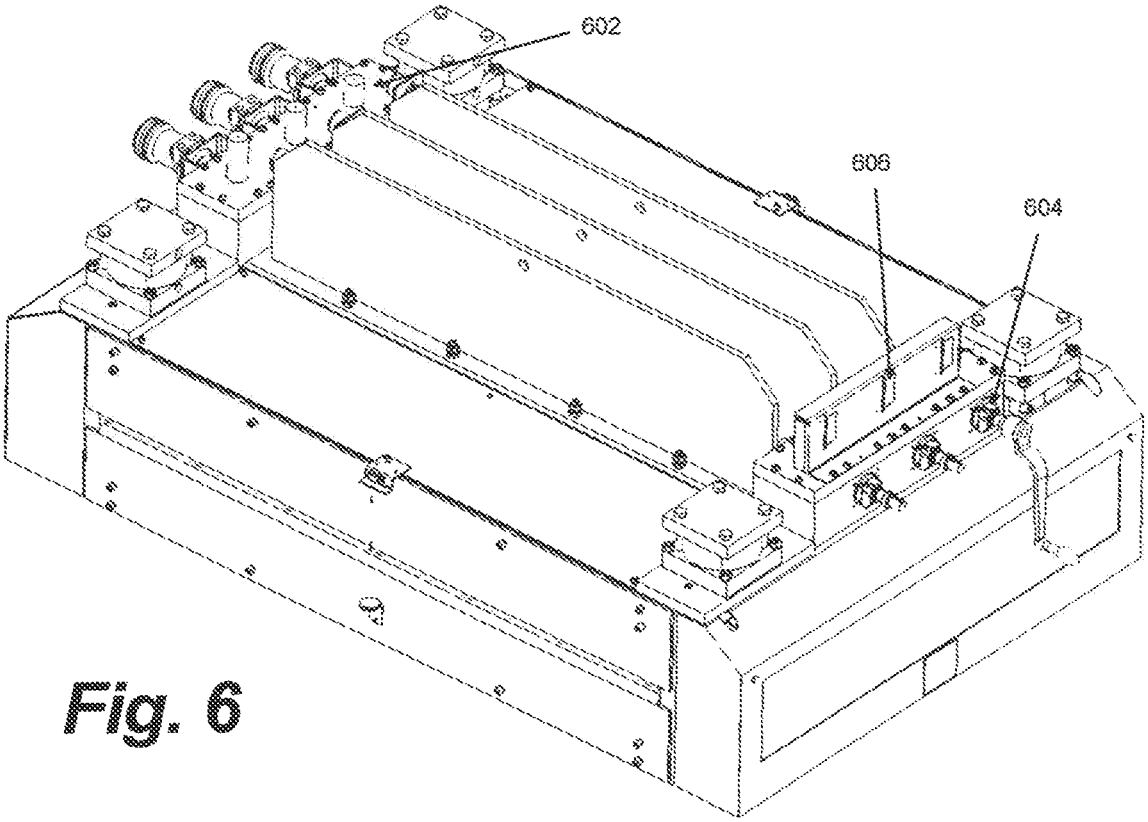
FIG. 6 is a top-down view showing the upper backup rollers assemblies.

FIG. 5 provides a different perspective of the lower backup roller assembly showing the dowel pins and bolts 112 aligning and securing the assembly to the straightener head. FIG. 6 is a top-down view showing the upper backup rollers assemblies. Again, each fin-like panel is connected to a separate plate supporting opposing sets of backup rollers, and each separate plate is fastened to a respective slide block though dowel pins and bolts.

Figure 4:
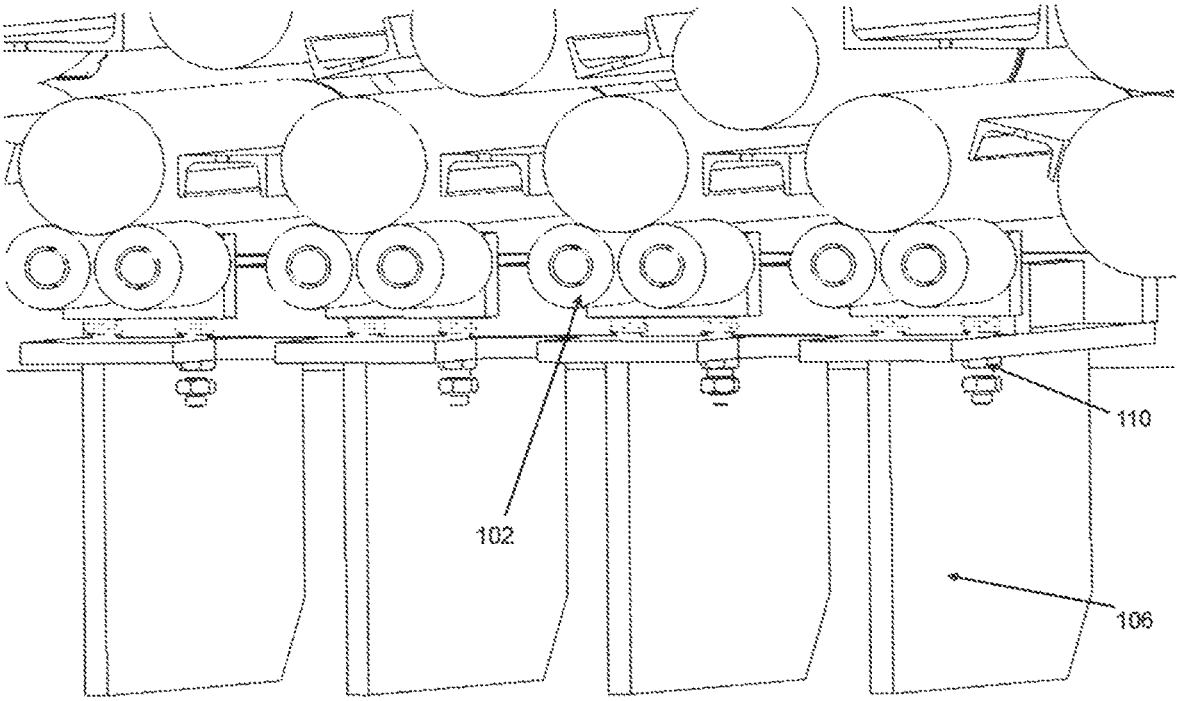
FIG. 4 shows a lower backup roller assembly in position.

In most instances the leveling jacks may be hand tightened since the idea is to make contact to the work roll without applying too much pressure. The use of leveling jacks and tension springs 214 and 314 enables the rollers to automatically adjust and compensate for equipment and material variations so as to maintain a consistent and even straightening process. This decreases the required setup time and field preventative maintenance required to maintain parallel rollers relative to each other and the head. FIG. 4 shows the lower backup roller assembly in position.

While the lower work rolls are fixed in position, alignment may be established through precise machining. However, since the upper work rolls are adjustable using screw jacks and slide blocks, located at opposite ends of each upper work roll, alignment accuracy, relative to the fixed lower work rolls is particularly challenging. The upper work rolls must be made perfectly parallel to the lower work rolls by adjusting each end, individually, and then locked together, using cross shafts on the screw jacks, to ensure correct straightening operation without damage to the material.

FIG. 6 is a top-down view showing the upper backup rollers assemblies. In straightening equipment, calibration of upper work roll position relative to a "known zero" position is critical to allow the end user the ability to precisely adjust the work roll engagement for their specific material properties while straightening. It is also crucial to allow the software controls to maintain a precise reference position to calibrate the jack-screw encoders 602, digital readouts 604, and/or mechanical scale markers 606.

Any time service or repair requires removal of the rollers, the technician or customer is required to calibrate the upper work rollers to the known "zero" position. In the past, long relatively heavy "timing bars" were placed between the upper and lower work roll banks to establish a "zero" position. It is standard industry practice to then use "off the shelf" screw jacks to provide the forces required to position and hold the rollers in the correct position for the material being processed. This calibration process is tedious and tends to be underperformed, reducing the quality of the material being processed.

Figure 7:
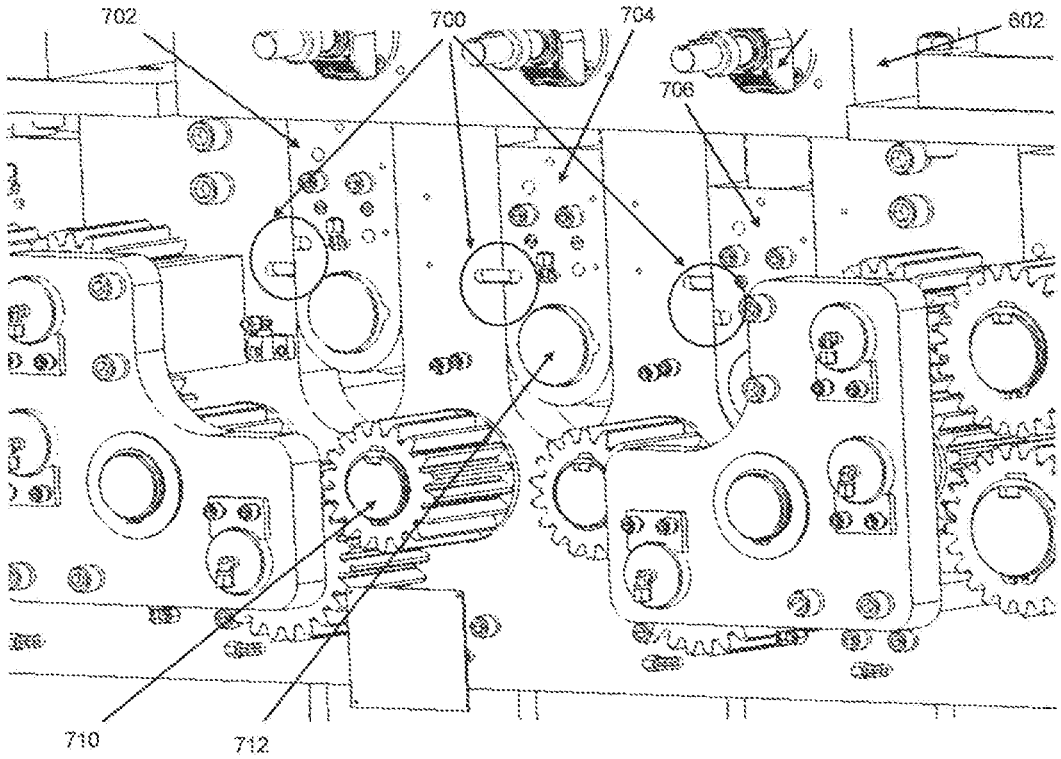
FIG. 7 depicts a slide block timing feature that allows for quick and precise calibration of the rollers.
Figure 8:
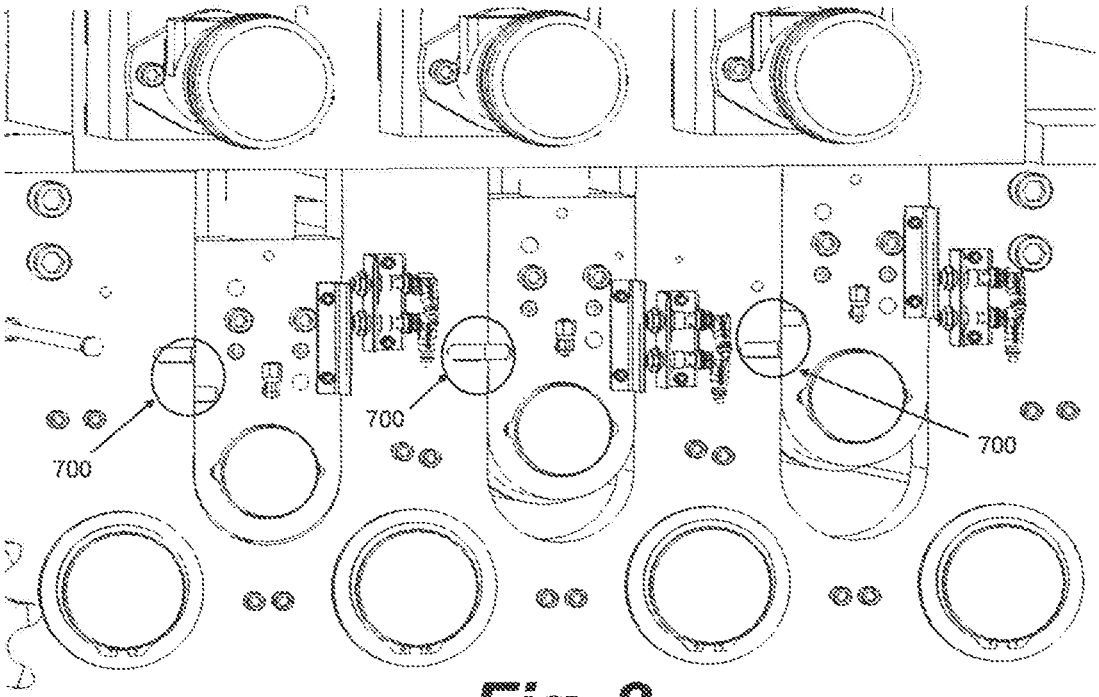
FIG. 8 shows three slide blocks, each with a cutout that can be compared to a corresponding cut-out in the straightener sideplate.

A different aspect of the invention allows for quick and precise alignment and calibration of the straightener roller banks and can also be used for the material edge guides on the straightener. As shown in FIGS. 7 and 8, a slide block timing feature 700 allows for quick and precise calibration of the rollers. A fixed lower roller is shown at 710, and an adjustable upper roller is depicted at 712. FIG. 8 shows three slide blocks 702, 704, 607, each with a cut-out that can be compared to a corresponding cut-out in the straightener side plate. While one side of the equipment is shown, the same situation exists on both sides.

The center slide block in FIG. 8 is at the zero position, wherein the slot in the slide block and the slot in the side plate are precisely aligned. This may be confirmed with a small, precision insert that fits into slots formed by both cut-outs when aligned. The small precision insert is far more convenient and easier to transport than a pair of large, heavy timing bars and it requires less experience, skill and time to perform the alignment and calibration process.

The cut-outs in the slide block may be precisely located based upon the distance to the center of the work roll in that slide block. The cut-out in the side plate may likewise be precisely located based upon the distance to the plane of the lower work rolls. Once a zero location is established, this position may be used to calibrate encoders, digital readouts, and/or mechanical scale markers. In the preferred embodiment, custom screw jacks are then used to allow for tighter center distances of the rollers while producing the required forces to hold the roller in position. By decreasing the roller center distances the straightener can affect the material more precisely.

The invention claimed is:

1. An improved straightener for straightening coil steel and other metals, comprising:

an upper bank of upper work rollers and a lower bank of lower work rollers, each work roller being rotatable about a respective axis of rotation, and wherein material to be straightened progresses through the upper and lower banks of the work rollers;

a set of backup rollers rotatable about two separate axes of rotation in contact with each work roller to reduce deformation of the work rollers during the straightening of the material;

wherein the backup rollers are supported on backup roller plates, and wherein the backup rollers are independently adjusted by moving the backup rollers toward and away from the backup roller plates to achieve a desired degree of contact between the backup rollers and the work rollers;

wherein each set of backup rollers for each work roller is supported on a separate, elongated backup roller plate, each plate being longitudinally aligned with a respective one of the upper work rollers, enabling each set of backup rollers for each upper work roller to be removably installed.

2. The improved straightener of claim 1, wherein:

the backup rollers in contact with the lower work rollers are supported between opposing blocks; and the backup rollers in contact with the lower work rollers are adjusted by moving the blocks toward and away from the backup roller plate.

3. The improved straightener of claim 2, further including tensioning springs between the opposing blocks and the backup roller plates.

4. The improved straightener of claim 1, further including a longitudinal support plate affixed to the back surface of each backup roller plate to reduce deformation of the backup roller plates.

5. The improved straightener of claim 4, wherein the longitudinal support plates are perpendicular to the backup roller plates and in plane with the rotational axis of the work roll associated with each backup roller plate.

6. The improved straightener of claim 1, further including opposing side plates with vertical slots formed therein, and wherein:

the work rollers associated with the upper bank are supported between opposing slide blocks that move up and down in the slots formed in the opposing side plates; and the side plates and slots include visual indicators to establish a zero position associated with each work roller in the upper bank.

7. The improved straightener of claim 6, wherein the visual indicators include notches or cut-outs in the slide blocks and the side plates.

8. The improved straightener of claim 7, wherein the notches or cut-outs in the slide blocks are precisely located based upon the distance to the center of the work roll in that slide block.

9. The improved straightener of claim 7, wherein the notches or cut-outs in the side plates are precisely located based upon the distance to the plane of the lower work rolls.

10. The improved straightener of claim 6, wherein the zero position is used to calibrate encoders, digital readouts or mechanical scale markers.

11. An improved straightener for straightening coil steel and other metals, comprising:

an upper bank of upper work rollers and a lower bank of lower work rollers, each work roller being rotatable about a respective axis of rotation, and wherein material to be straightened progresses through the upper and lower banks of the work rollers;

opposing side plates with vertical slots formed therein;

wherein the work rollers associated with the upper bank are supported between opposing slide blocks that move up and down in the slots formed in the opposing side plates; and wherein the side plates and slots include visual indicators to establish a zero position associated with each work roller in the upper bank.

12. The improved straightener of claim 11, wherein the visual indicators are notches or cut-outs in the slide blocks and the side plates.

13. The improved straightener of claim 12, wherein the notches or cut-outs in the slide blocks are precisely located based upon the distance to the center of the work roll in that slide block.

14. The improved straightener of claim 12, wherein the notches or cut-outs in the side plates are precisely located based upon the distance to the plane of the lower work rolls.

15. The improved straightener of claim 11, wherein the zero position is used to calibrate encoders, digital readouts or mechanical scale markers.

16. The improved straightener of claim 1, wherein each set of backup rollers comprises a plurality of rollers on each of the two separate axes of rotation.

17. The improved straightener of claim 16, wherein each set of backup rollers comprises four rollers, with two rollers rotatable about each of the two separate axes of rotation.

* * * * *